US005519994A

United States Patent [19]

Hill

[11] Patent Number: 5,519,994

[45] Date of Patent: May 28, 1996

[54] MUFFLER WITH INLET PIPE EQUALIZER

[75] Inventor: William E. Hill, Ann Arbor, Mich.

[73] Assignee: Tennessee Gas Pipeline Company, Deerfield, Ill.

[21] Appl. No.: 198,521

[22] Filed: Feb. 18, 1994

[51] Int. Cl.[6] ..... F01N 1/00

[52] U.S. Cl. ..... 60/313; 60/323; 181/238

[58] Field of Search ..... 60/312, 313, 323; 181/238, 240

[56] References Cited

U.S. PATENT DOCUMENTS

| | | | |
|---|---|---|---|
| 2,305,946 | 12/1942 | Wilson et al. | 60/323 |
| 3,419,107 | 12/1968 | Jozepaitis | 181/240 |
| 3,665,712 | 5/1972 | Tenney | 60/314 |
| 3,948,348 | 4/1976 | Bychinsky | 181/206 |
| 4,165,798 | 8/1979 | Martinez | 181/268 |
| 5,152,138 | 10/1992 | Tanabe et al. | 60/123 |
| 5,327,722 | 7/1994 | Clegg et al. | 60/323 |

*Primary Examiner*—Ira S. Lazarus
*Assistant Examiner*—Leonard Heyman
*Attorney, Agent, or Firm*—Harness, Dickey & Pierce

[57] ABSTRACT

An arrangement for silencing the exhaust gases discharged from a multi-cylinder internal combustion engine, wherein the exhaust gas is discharged in first and second streams from separate exhaust gas manifolds on opposite sides of the engine and the two streams traverse a different but equal lengthed path to be combined into a single stream to be presented to exhaust system components, such as catalytic converters and separate mufflers. In one embodiment, the streams pass through conduits integrally formed, in part, with through structure of a muffler. In other embodiments, the stream paths are equalized by being passed through conduits formed in closed shells.

13 Claims, 5 Drawing Sheets

14
16
28
26
32
36
24
34
22
30
20
10
18

26
A
16
16
24
22
30
34

MUFFLER WITH INLET PIPE EQUALIZER

BACKGROUND OF THE INVENTION

This invention relates to an arrangement for silencing the exhaust gases discharged in first and second streams from separate exhaust gas manifolds of a multi-cylinder internal combustion engine, and more particularly, to a silencing arrangement wherein the two streams traverse different but equal lengthed paths before being combined into a single stream.

A multi-cylinder internal combustion engine is equipped with two parallel rows of cylinders with each row typically being on a different side of the engine and an exhaust system for conducting the burned gases from the engine. The exhaust system includes two manifolds each covering a respective row of cylinders and including an exhaust pipe, and a Y-pipe for connecting the exhaust pipes to a common discharge pipe. The exhaust gases are then passed rearwardly to an acoustic muffler for silencing the exhaust gases.

In such arrangement, the engine is symmetrical to the vehicle and the distance between the respective manifolds and the Y-pipe is the same. During engine operation, the exhaust gases are discharged as pressure pulses in a regular but repeating pattern and the peaks of the pulses are distributed, in time, in such a way as to form a smooth pressure wave of uniform amplitude.

In recent vehicle designs, the location of the engine and the transmission as well as required placement of catalytic converters has resulted in the distance that the gas streams must traverse in moving between the two manifolds and the Y-pipe not being the same. If the distance between the respective manifolds and the Y-pipe are not the same, then the two gas streams will arrive at the Y-pipe at a different time. If this happens, the pressure waves can adversely combine to provide irregular pulsations (e.g., points where the pressure is zero or points where the pulses combine). The noise can be unexpectedly high.

An object of this invention is provision of an exhaust system for an internal combustion engine, which can be integrated with an exhaust muffler, that is effective as a sound silencer, decreases the gas velocity, attenuates sound pressure levels and combines separate exhaust gas streams into a single stream of substantially uniform pressure pulses.

Another object of this invention is provision of an equalizer and compact muffler design which contains within a sheet steel cylindrical shell, expansion chambers, resonance chambers, baffles, and perforated tubes whose function is to intermingle and expand the gases to attenuate the exhaust noise.

Commensurate with the design or redesign of a vehicle and the location of its engine and exhaust system is the desire that the mounting not adversely effect the engine performance, be cost effective, and achieve optimal sound attenuation.

SUMMARY OF THE INVENTION

According to this invention there is provided an exhaust system for receiving and silencing the exhaust gases discharged from first and second exhaust manifolds disposed on opposite sides of an internal combustion engine during operation of the engine, the exhaust gases being separated by the manifolds into a first and second stream. The two streams then traverse a different but equal lengthed path whereupon the two streams are combined into a single stream.

The exhaust system includes a first and second exhaust pipe with the first exhaust pipe being shorter than the second exhaust pipe. The shorter first exhaust pipe directs the first stream of exhaust gases along a first path and has an inlet connected to the first manifold and an outlet. The longer second exhaust pipe directs the second stream of exhaust gases along a second path and has an inlet connected to the second manifold and an outlet. The exhaust system also includes length equalizing means, connected to the outlet of the shorter exhaust pipe and defining a discharge end, for making the distance that the first stream must traverse when passing from the inlet end of the shorter exhaust pipe and the discharge end the same as the distance that the second stream must traverse when passing from the inlet end of longer exhaust pipe and the outlet end thereof.

In one embodiment, the length equalizing means is integrally formed, in part, within muffler structure, and includes a closed cylindrical shell having a pair of endwalls, a plurality of partitions which divide the shell interior into a series of chambers including resonator and expansion chambers, a retroverted flow structure having an inlet connected to the outlet of the shorter first exhaust pipe for communicating the first stream of exhaust gases through a first and second chamber of the muffler shell and discharging the first stream via the discharge end into the first chamber, and an inlet conduit, formed as an end portion of the longer second exhaust pipe and including the outlet end, for discharging the second stream via the outlet end into the first chamber, the flow structure and the inlet conduit each extending through the first endwall. An outlet conduit is supported in the second endwall and has an inlet disposed in the first chamber for receiving and discharging the two streams of exhaust gases from the shell.

In another embodiment, the length equalizing means includes a closed shell providing an inlet connected to the shorter lengthed first exhaust pipe and an outlet, the shell including an array of conduits that form a retroverted gas flow passage between the inlet and the outlet, the length of the longer second exhaust pipe being substantially the same as the length of the retroverted conduits extending between the inlet and the outlet and the shorter lengthed first exhaust pipe. In one illustrative arrangement, a cylindrical shell encloses first and second cylindrical conduits, the first conduit having one end secured in the inlet to the shell and an outlet opening within the shell adjacent to the outlet from the shell, and the second conduit having one end secured in the outlet to the shell and an outlet opening within the shell adjacent to the inlet to the shell.

In yet another embodiment, the length equalizing means is similar to the muffler structure and includes a closed shell, partitions which divide the shell interior into a series of chambers, a retroverted flow structure and an inlet conduit connected, respectively, to the shorter lengthed first exhaust pipe and the longer lengthed second exhaust pipe for communicating exhaust gases into a first chamber of the shell as first and second streams and along first and second paths, and an outlet conduit having an inlet in the first chamber for receiving, combining and discharging the two streams of exhaust gases from the shell.

These and other objects and advantages will become apparent to those skilled in the art upon the reading of the following description with reference to the accompanying drawings wherein like numbers refer to like parts throughout the several views.

DETAILED DESCRIPTION OF THE PREFERRED EMBODIMENT

Figures 1, 1A:
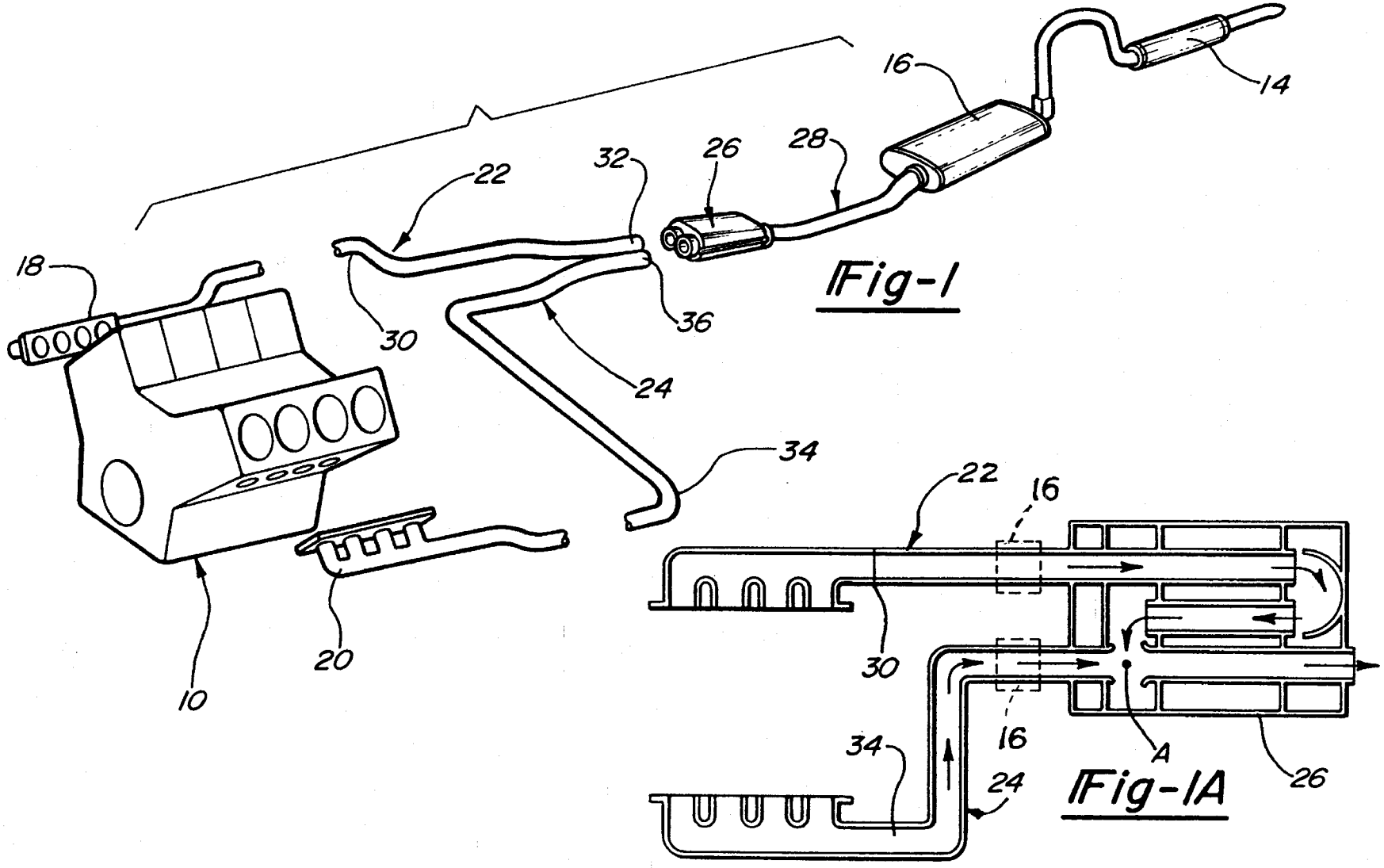
FIG. 1 is a perspective view of an automobile vehicle including an engine having two exhaust gas manifolds and an exhaust system, including muffler structure, for equalizing the distance that separated exhaust gas streams must traverse when moving along different flow paths from each manifold and into a chamber of the muffler, according to this invention.
FIG. 1A is a detail view showing complete paths through the equalizer muffler.
Figure 2:
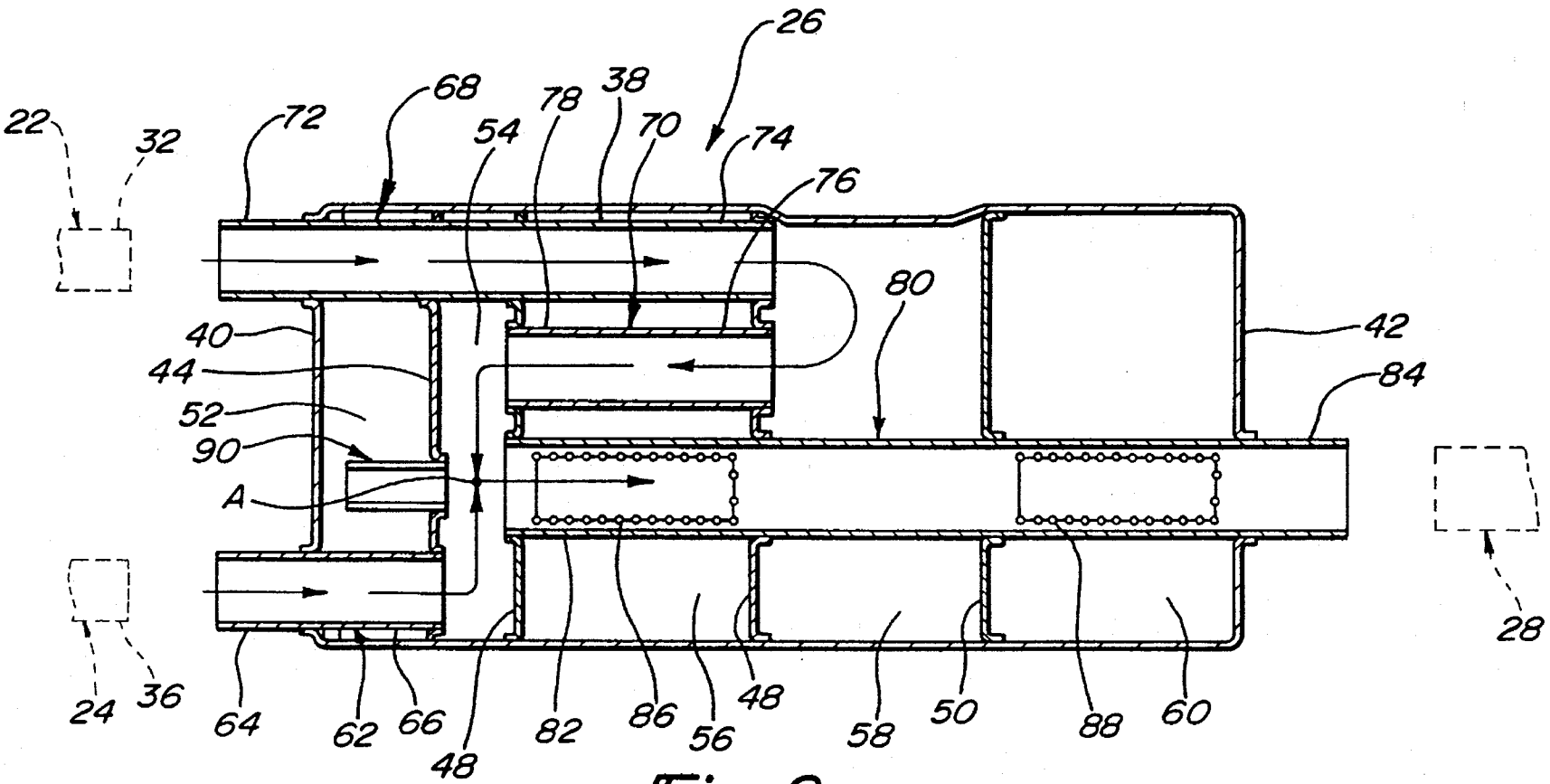
FIG. 2 is a cross-section of the muffler illustrated in FIG. 1 for equalizing the flow paths according to this invention.

Referring now to the drawings, FIGS. 1–7 illustrate apparatus for silencing the operation of an internal combustion engine. In FIG. 1 there is shown a conventional internal combustion engine 10 and an exhaust system 12 including one or more mufflers 14 for silencing the noises produced during operation of the engine and a catalytic converter 16 for removing pollutants from the exhaust gases. As illustrated, the engine is generally symmetrical about a midplane and includes a first and a second row of engine cylinders, each arranged on an opposite side of the engine.

According to this invention, the exhaust system 12 includes a pair of exhaust gas manifolds 18 and 20 each connected in covering relation to a respective row of cylinders, a pair of exhaust pipes 22 and 24, a muffler 26 and a discharge conduit 28 connected to the muffler 14 and the catalytic converter 16. As illustrated in FIG. 1A, the catalytic converter 16 (shown in phantom) could be located in the lines 22 and 24. The exhaust gas manifolds 18 and 20 operate to capture the exhaust gases which result from the combustion of the air-fuel mixture in the engine, to lead them away from the engine with low resistance, pass them through the exhaust gas system and discharge them into the atmosphere.

In the arrangement shown in FIG. 1, the exhaust gases discharged into the first and second exhaust gas manifolds 18 and 20 define separated first and second gas streams. The first exhaust pipe 22 has an inlet end 30 connected to the first exhaust gas manifold 18 for receiving the first gas stream and an outlet end 32 for discharging the gas stream into the muffler 26. The second exhaust pipe 24 has an inlet end 34 connected to the second exhaust gas manifold 20 for receiving the second gas stream and an outlet end 36 for discharging the gas stream into the muffler 26. The first exhaust pipe 22 is shorter than the second exhaust pipe 24 such that the first gas stream will reach its outlet end 32 sooner than the second gas stream will reach its outlet end 36. If the outlet ends 32 and 36 were joined by a conventional Y-pipe (not shown), the streams would be out of phase. This situation creates additional noise frequencies that make exhaust silencing more difficult.

To eliminate this situation, according to this invention, the exhaust system 12 is integrated into the structure of the muffler 26. In particular, the muffler 26 comprises an elongated tubular shell or housing 38 which is formed of sheet steel (as are the internal parts) that is rolled into an oval shape and the overlapping edges spot-welded together or lock-seamed according to conventional practice. Preferably, the casing is generally symmetrically disposed relative to a central longitudinal axis and the lock seam is positioned so as to extend along the bottom edge of the casing. The muffler 26 has first and second ends closed by endwalls 40 and 42, and a plurality of transverse partitions 44, 46, 48 and 50 disposed between the endwalls, the endwalls and the partitions being peripherally attached to the shell 38 to longitudinally divide the shell interior into a plurality of chambers 52, 54, 56, 58 and 60.

To equalize the distances that the two gas streams must travel, the muffler 26 includes an inlet conduit 62 and a retroverted flow structure. The inlet conduit 62 has an inlet end portion 64 supported in the endwall 40 and connected to the outlet end 36 of the longer second exhaust pipe 24 and an outlet end portion 66 supported in the first partition 44 to receive and discharge the second gas stream into the second chamber 54. The retroverted flow structure includes an inlet conduit 68 and a reverse flow conduit 70, the inlet conduit 68 having an inlet end portion 72 supported in the endwall 40 and connected to the outlet end 32 of the shorter first exhaust pipe 22 and an outlet end portion 74 supported in the second and third partitions 46 and 48 to receive and discharge the first gas stream into the fourth chamber 58. The reverse flow conduit 70 has an inlet end 76 supported in the partition 48 and an outlet end 78 supported in the partition 46 to communicate the exhaust gases received in the chamber 58 to the chamber 54.

An outlet conduit 80 has an inlet end 82 supported in the partition 46 and an outlet end portion 84 supported in the endwall 42. The distance the first gas stream must traverse in passing from the inlet end 30 of the shorter first exhaust pipe 22, through the inlet conduit 68 and into the chamber 58, and through the reverse flow conduit 70 and into the chamber 54 to the point "A" adjacent to the inlet end 82 of the outlet conduit 80 is substantially equal to the distance the second gas stream must traverse in passing from the inlet end 34 of the longer second exhaust pipe 24, through the inlet conduit 62 and into the chamber 54 to the point "A" adjacent to the inlet end 82. The paths do not have to be exactly equal to achieve substantial reduction of unwanted noise frequencies.

To aid in the silencing aspects, the outlet conduit 80 includes a perforated portion (or louver patch) 86 opening in the expansion chamber 56 formed between the partitions 46 and 48, and a perforated portion (or louver patch) 88 opening in the expansion chamber 60 formed between the partition 50 and the endwall 42. Further, a tuning tube 90 is supported in the partition 44 and has an inlet coaxially aligned with the inlet end 82 to the outlet conduit 80 and opens into the resonator chamber 52 adjacent to the endwall 40. The dimensions of the tuning tube relative to the volume of the resonator chamber are chosen to enable relatively low frequencies of sound to be attenuated.

Figure 3:
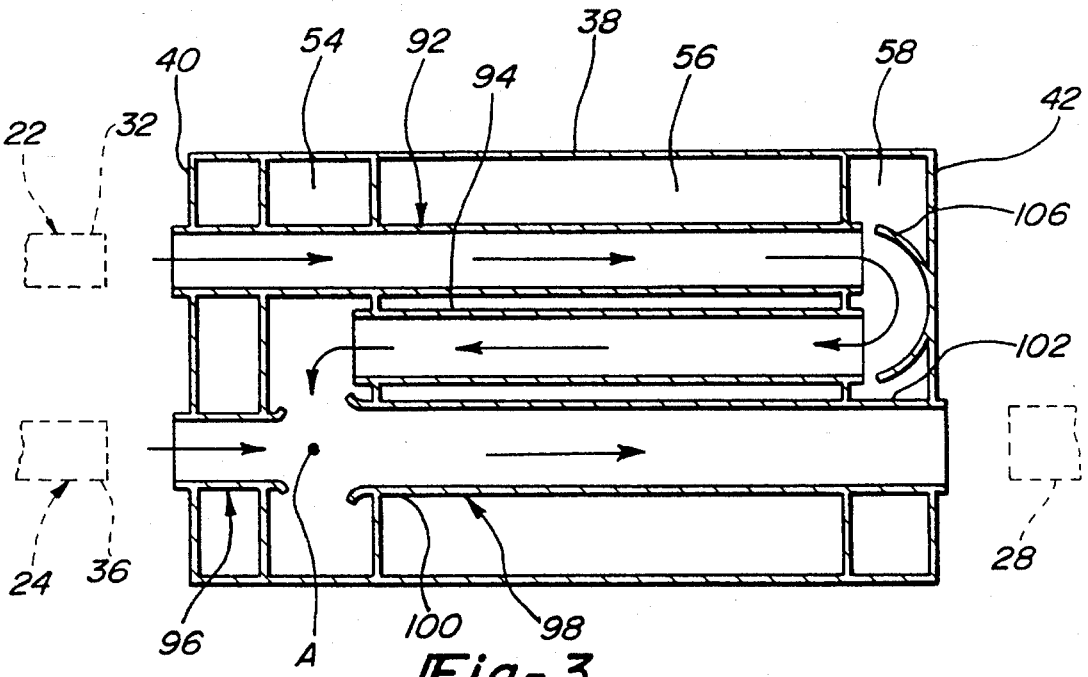
FIG. 3 is another arrangement for equalizing two exhaust gas flow paths, using a shell having a reverse flow structure, according to this invention.
Figure 4:
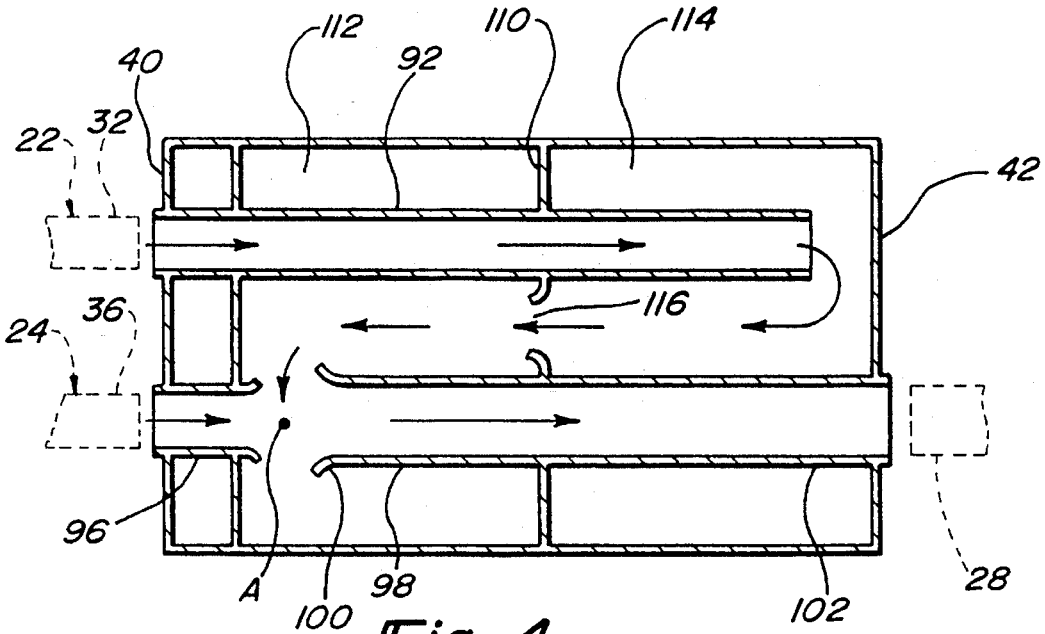
FIG. 4 is another arrangement for equalizing two exhaust gas flow paths, using a shell having a reverse flow structure, according to this invention.
Figure 5:
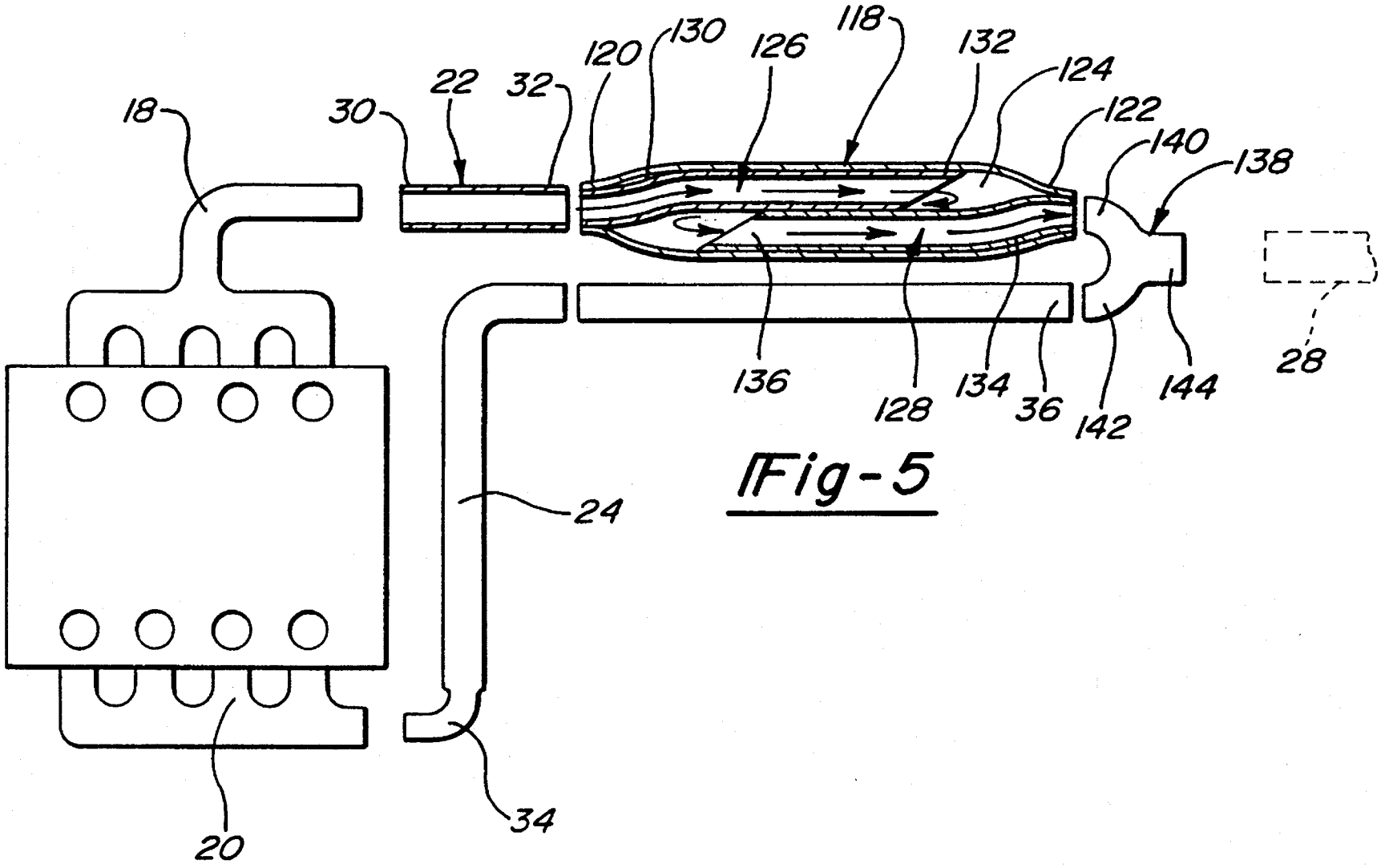
FIG. 5 is an another arrangement for equalizing two exhaust gas flow paths, using a shell having a reverse flow structure, according to this invention.

As shown in FIGS. 3–5, path equalization can be accomplished by reverse flow structure in combination with a closed shell. In FIG. 3, as described in connection with the embodiment of FIGS. 1–2, the shorter first exhaust pipe 22 and the longer second exhaust pipe 24 are connected to the first and second exhaust gas manifolds 18 and 20 and to the tubular housing 38 closed at its opposite ends by the first and second endwalls 40 and 42. The housing 38 includes partitions for partitioning the housing interior into longitudinally spaced chambers including the chamber 52 adjacent to the first endwall 40 and the chamber 58 adjacent to the second endwall 42.

In the embodiment of FIG. 3, four generally cylindrical conduits 92, 94, 96 and 98 are utilized first to communicate the two separated gas streams into the housing 38, the interior point "A" of which defining the location at which the two gas streams will have passed the same distance from their respective manifolds, and then to communicate a combined gas stream outwardly of the housing. The conduits 92 and 94 form a retroverted gas flow passage, the inlet conduit 92 receiving the first gas stream from the outlet end 32 of the shorter first exhaust pipe 22 and communicating same through the chambers 52, 54 and 56 and into the chamber 58, and the reverse conduit 94 receiving the gas stream from the chamber 58 and communicating same into the chamber 54. The inlet conduit 96 receives the second gas stream from the outlet end 36 of the longer second exhaust pipe 24 and discharges same into the chamber 54. The outlet conduit 98 has an inlet 100 in the chamber 54 and an outlet 102 for communicating the exhaust gases in the chamber 54 outwardly of the housing 38. The inlet conduit 96 has its outlet juxtaposed with and coaxially aligned with the inlet 100 to the outlet conduit 98.

Located in the chamber 58 is a flow directing shield 106 for directing the flow of the first gas stream discharged from the inlet conduit 92 into the reverse conduit 94. The shield 106 is useful in assuring the velocity head of the first gas stream does not become attenuated when the stream is passed through the chamber 58 and undergoes the 180° change in direction.

The first and second gas streams are passed along a first and a second path, the two paths being substantially identical in distance whereby the exhaust gases will reach the point "A" adjacent to the inlet 100 to the outlet conduit 98 at about the same time. The first path extends from the inlet end 30 to and through the shorter first exhaust pipe 22, through the flow reverse conduits 92 and 94, and into the chamber 54 for entry at the point "A" into the inlet 100 to the outlet conduit 98. The second path extends from the inlet end 34 to and through the longer second exhaust pipe 24, through the inlet conduit 96, and into the chamber 54 for entry at the point "A" into the inlet 100 to the outlet conduit 98. The length equalizing arrangement in FIG. 4 is similar to that shown in FIG. 3 but differs in that a partition 110 is utilized to form chambers 112 and 114, and the retroverting conduit 94 is formed by an opening 116 in the partition 110. The first gas stream is passed from the inlet conduit 92 into the chamber 114 and the opening 116 defines a return path into the chamber 112. This arrangement desirably provides a low cost resonator structure but could place a higher back pressure on the engine cylinders in some applications.

Another embodiment is disclosed in connection with FIG. 5 and includes a tubular housing 118 having an inlet 120 and an outlet 122 arranged along a longitudinal axis and forming an interior chamber 124, the shorter first exhaust pipe 22 is connected to the first exhaust gas manifold 18 and to the housing inlet 120, and the longer second exhaust pipe 24 is connected to the second exhaust gas manifold 20. A retroverted gas flow passage is formed in the housing 118 for receiving and causing the first exhaust gas stream to undergo a 180° change in direction and includes first and second flow sections 126 and 128. The first flow section 126 has an inlet end portion 130 mounted in the housing inlet 120 for receiving the first gas stream from the first exhaust gas manifold 18 and an outlet 132 opening in the chamber 124 adjacent to the housing outlet 122. The second flow section 128 has an outlet end portion 134 in the housing outlet 122 and an inlet 136 opening in the chamber 124 adjacent to the housing inlet 120. The flow sections 126 and 128 comprise cylindrical conduits and each extends along a respective longitudinal axis in superposed relation with one another, the interior cross-section of the housing 118 being substantially the same as the combined cross-section of the two flow sections 126 and 128 such that the flow sections are press-fitted into engagement with one another and the housing wall. The distance that the first gas stream must traverse in passing through the shorter first exhaust pipe 22, into the inlet 120 and through the first flow section 126 to the outlet 132, to the inlet 136, through the second flow section 128 and to the outlet 122 of the housing 118 is substantially the same as the distance the second gas stream must traverse in passing between the ends 34 and 36 of the longer second exhaust pipe 24. A conventional Y-pipe 138 has its inlets 140 and 142 connected to the outlet ends 36 and 122 and its outlet 144 connected to the discharge conduit 28.

Figure 6:
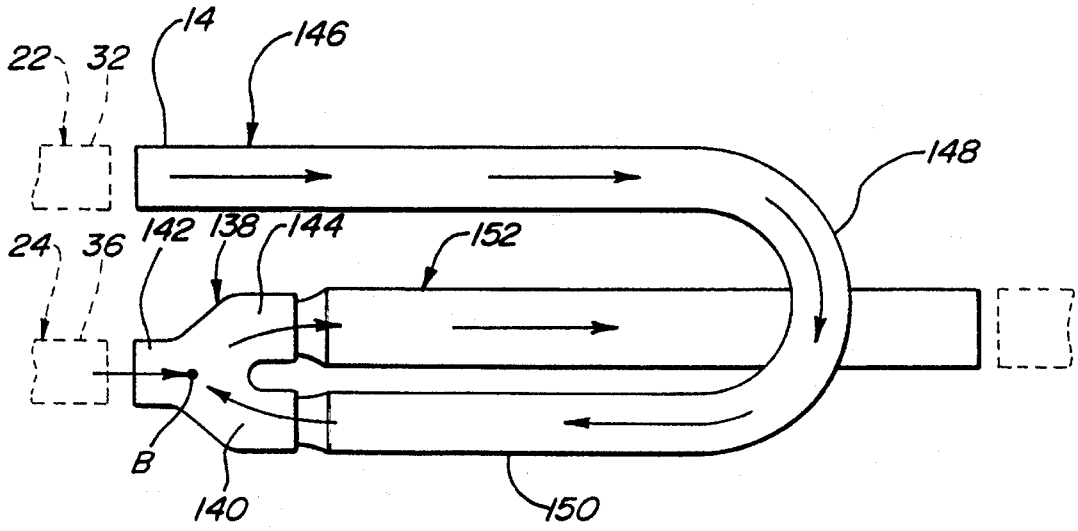
FIGS. 6 and 7 are arrangements using a flow reverse structure for equalizing two exhaust gas flow paths according to this invention.
Figure 7:
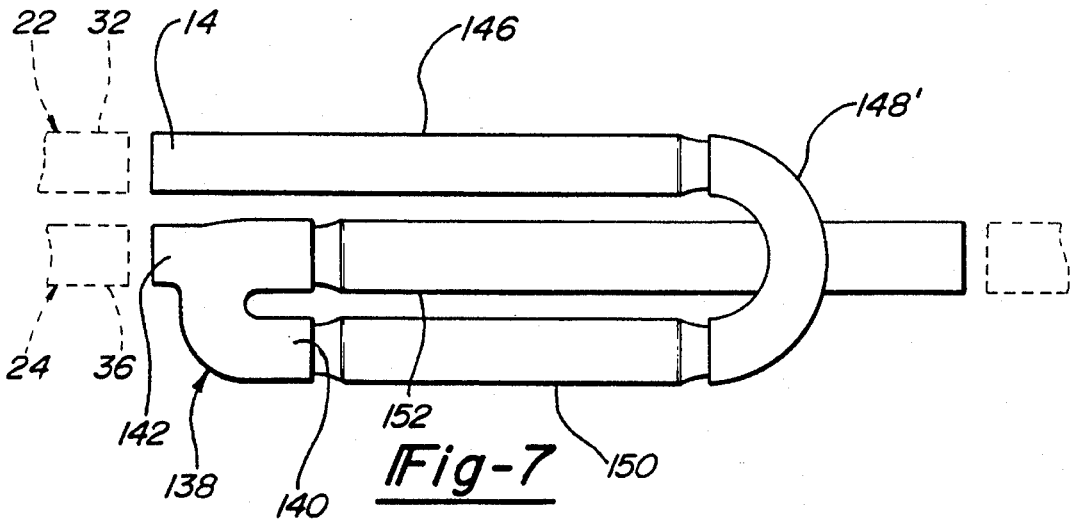

FIGS. 6–7 are further preferred arrangements using flow reverse structure for equalizing two gas flow paths according to this invention. In each arrangement there is provided a U-shaped retroverted gas flow structure which includes an inlet conduit 146 having an inlet 147 connected to the outlet end 32 of the shorter first exhaust pipe 22, a curved section 148 and a return conduit 150, a Y-pipe 138, and an outlet conduit 152. The Y-pipe 138 has its inlet 140 connected to the return conduit 150, its inlet 142 connected to the outlet end 36 of the longer second exhaust pipe 24, and its outlet 144 connected to the outlet conduit 152. The distance between the inlet 147 to the retroverted flow structure and through the sections 146, 148 and 150 to the inlet 140 at the point "B" combined with the length of the shorter first exhaust pipe 22 is the same as the length of the longer second exhaust pipe 24 and the distance of the inlet 142 to reach the point "B".

In the embodiment illustrated in FIG. 6, the retroverted gas flow structure, constituted by elements 146, 148 and 150, is formed as one piece. The use of the Y-pipe 138 results in only one stamped joint being required. In the embodiment illustrated in FIG. 7, the Y-pipe 138 and curved section 148' form two stamped joints. It is believed that these arrangements will reduce the backpressure acting on the engine.

While the above detailed description describes the preferred embodiments of the present invention, it should be understood that the present invention is susceptible to modification, variation and alteration without deviating from the scope and fair meaning of the subjoined claims.

What is claimed is:

1. An exhaust system for use with an internal combustion engine of the type including first and second exhaust manifolds each associated with a respective row of engine cylinders for discharging exhaust gases in respective first and second streams during operation of the engine, the exhaust system comprising:

a first pipe having a first end connected to the first exhaust manifold for receiving the first gas stream and a second end;

a second pipe having a first end connected to the second exhaust manifold for receiving the second gas stream and a second end, the second pipe being shorter than said first pipe; and a muffler for silencing said exhaust gases, said muffler including a first inlet conduit having a first end connected to the second end of said first pipe and an outlet in said muffler, a reverse flow structure having a first end connected to the second end of said second pipe and an outlet in said muffler, and an outlet conduit having an inlet in said muffler for receiving and combining said first and second streams and an outlet for discharging a combined gas stream outwardly of said muffler, the distance between the first end of the longer first pipe and the outlet of said inlet conduit being substantially equal to the distance between the first end of the shorter second pipe and the outlet of said reverse flow structure.

2. The exhaust system as claimed in claim 1, wherein said muffler comprises an elongated tubular shell having first and second ends closed, respectively, by a first and a second endwall and a plurality of transverse partitions disposed between said endwalls, the endwalls and the partitions peripherally attached to said shell, the first endwall supporting said inlet conduit and said reverse flow structure, the second endwall supporting said outlet conduit, and the partitions longitudinally dividing the shell interior into a corresponding plurality of chambers including a first chamber into which the outlets and said inlet are located and a second chamber, and said reverse flow structure comprises:

a second inlet conduit including the first end of said reverse flow structure and supported in the first endwall and an outlet end portion supported in a first of said partitions for communicating said second gas stream into said second chamber, and a reverse flow conduit for communicating the second gas stream from the second chamber into the first chamber, said reverse flow conduit including the second end of said structure and supported in said first partition and an inlet end portion communicating with said second chamber.

3. The exhaust system as claimed in claim 2, wherein a second partition is disposed between said first partition and said second endwall and forms a first expansion chamber with the second endwall, a third partition is adjacent to said first endwall and forms a second expansion chamber therewith, and said outlet conduit is supported by said partitions and includes first and second perforated end portions, the first perforated end portion being disposed in the first expansion chamber and the second perforated end portion being disposed in the second expansion chamber.

4. The exhaust system as claimed in claim 3, wherein a fourth partition is adjacent to said first endwall and forms a resonator chamber therewith, and a tuning tube has an inlet supported in said fourth partition and an outlet in the resonator chamber.

5. An exhaust system for the exhaust gases of an internal combustion engine wherein the exhaust gases are discharged as first and second streams into respective first and second exhaust manifolds of the engine, the exhaust system comprising:

a first pipe and a second pipe each having an inlet connected, respectively, to said first and second exhaust manifolds and an outlet, the first pipe being shorter than the second pipe; and a tubular housing closed at its opposite ends by a first and a second endwall, said tubular housing including:

partition means for partitioning the housing interior into a plurality of chambers including a first chamber adjacent to said first endwall and a second chamber adjacent to said second endwall;

retroverted gas flow passage means, including a first and a second flow section, for communicating the first stream of exhaust gases received from the outlet of the shorter first pipe through said first and second chambers and discharging same into said first chamber;

a third flow section for communicating the second stream of exhaust gases received from the outlet of the longer second pipe and discharging same into said first chamber; and a fourth flow section having an inlet in said first chamber and an outlet, said fourth flow section for communicating the exhaust gases in said first chamber outwardly of said housing, the first and second gas streams passing along a first and a second path, the first path extending from the inlet to and through the shorter first pipe, through the first and second flow sections, and into the first flow chamber for entry into the inlet to the fourth flow section, and the second path extending from the inlet to and through the longer second pipe, through the third flow section, and into the first flow chamber for entry into the inlet to the fourth flow section, the first flow path and the second flow path being substantially identical in distance.

6. The exhaust system as claimed in claim 5 wherein the outlet of said third flow section is juxtaposed with the inlet of said fourth flow section.

7. The exhaust system as claimed in claim 5 wherein the outlet from said third flow section is coaxially aligned with the inlet to said fourth flow section.

8. The exhaust system as claimed in claim 6 wherein each said flow section comprises a cylindrical conduit having opposite end portions, and the partition means comprises a first partition for positioning the outlet from the second flow section and the inlet to the fourth flow section relative to the first chamber, and a second partition for positioning the outlet from the first flow section and the inlet to the second flow section relative to the second flow chamber.

9. The exhaust system as claimed in claim 6 wherein each of said first, third and fourth flow sections comprises a cylindrical conduit, and said partition means comprises a partition having an opening therein and forming a first chamber with the first endwall and a second chamber with the second endwall, the partition supporting an end portion of the first flow section interiorly of the second chamber and an end portion of said third flow section interiorly of said first chamber, and the second flow section comprises the opening for communicating exhaust gases from the second chamber into the first chamber.

10. An exhaust system for an internal combustion engine of the type wherein the exhaust gases are discharged from the respective first and second exhaust manifolds as first and second streams, the exhaust system comprising:

a first pipe and a second pipe each having an inlet connectible, respectively, to the first and second exhaust manifold, the first pipe being shorter than the second pipe; and a tubular housing closed at its opposite ends by a first and a second endwall, said housing including:

a partition attached to the housing and including an opening therethrough, the partition dividing the housing interior into a first chamber adjacent to said first endwall and a second chamber adjacent to said second endwall;

a first flow section for communicating exhaust gases received from the shorter first pipe into the second chamber;

a second flow section for communicating exhaust gases from the second chamber to the first chamber via said opening, said first chamber forming a resonating chamber;

a third flow section for communicating exhaust gases received from the longer second pipe into the first chamber; and a fourth flow section having an inlet in said first chamber and an outlet for discharging the two exhaust gas streams in the first chamber outwardly of the housing, the first and second gas streams passing from the exhaust manifolds along first and second paths which are different but substantially equal in distance whereby the two exhaust gases will reach the inlet to the fourth flow section at about the same time, the first path extending from the inlet to and through the shorter first pipe, through the first flow section and into the second chamber, through the opening in the partition and into the first chamber and to the inlet to the fourth flow section, and the second path extending from the inlet to and through the longer second pipe, into the first chamber and to the inlet to the fourth flow section.

11. In a multi-cylinder internal combustion engine having first and second exhaust manifolds disposed on opposite sides of the engine, an exhaust system for receiving and silencing the exhaust gases discharged from the manifolds during operation of the engine, the exhaust system comprising:

a first exhaust pipe having a first length and connected at one end thereof to the first manifold;

a second exhaust pipe having a second length and connected at one end thereof to the second manifold, the first length being greater than the second length; and length equalizing means, connected to the other ends of the two exhaust pipes and defining a second end for making the distance that the exhaust gases must traverse when passing from the first manifold to the second end the same as that when passing from the second manifold to the second end wherein the length equalizing means comprises a closed cylindrical housing, first and second inlet pipes connected, respectively, to the first and second exhaust pipes for communicating exhaust gas into first and second chambers of the housing, a flow reversing pipe for communicating exhaust gas from the second chamber to the first chamber, and an outlet pipe for discharging gases from the first chamber, the length of the first exhaust and inlet pipes being equal to that of the second exhaust and inlet pipes and the reversing pipe.

12. The invention as claimed in claim 11, said housing further including a pair of spaced expansion chambers, and the outlet pipe having a central wall portion disposed in the second chamber and between perforated end portions disposed in a respective one of said expansion chambers.

13. The invention as claimed in claim 11, said housing further including a tuning tube in juxtaposition with said outlet pipe and extending into a resonator chamber adjacent to said first inlet pipe.

* * * * *